US010039222B1

(12) United States Patent
Keigley

(10) Patent No.: US 10,039,222 B1
(45) Date of Patent: Aug. 7, 2018

(54) TOW-BEHIND GRADING TOOL AND OPERATION THEREOF

(71) Applicant: Absolute Innovations, Inc., Mishawaka, IN (US)

(72) Inventor: Kevin V. Keigley, Osceola, IN (US)

(73) Assignee: ABI Attachments, Inc., Mishawaka, IN (US)

( * ) Notice: Subject to any disclaimer, the term of this patent is extended or adjusted under 35 U.S.C. 154(b) by 277 days.

(21) Appl. No.: 15/095,274

(22) Filed: Apr. 11, 2016

Related U.S. Application Data

(60) Provisional application No. 62/144,973, filed on Apr. 9, 2015.

(51) Int. Cl.
*A01B 49/02* (2006.01)
*A01B 31/00* (2006.01)
*A01B 35/06* (2006.01)

(52) U.S. Cl.
CPC ..... *A01B 49/027* (2013.01); *A01B 31/00* (2013.01); *A01B 35/06* (2013.01); *A01B 49/02* (2013.01)

(58) Field of Classification Search
CPC ..... A01B 73/00; A01B 31/00; A01B 35/04; A01B 49/02; A01B 49/027; A01B 21/086; A01B 63/108; A01B 63/111; A01B 35/06; E02F 3/7604; E02F 3/7622
USPC .... 172/145, 197, 198, 195, 200, 495.1, 664, 172/684.5
See application file for complete search history.

(56) References Cited

U.S. PATENT DOCUMENTS

| | | | | |
|---|---|---|---|---|
| 512,573 | A | | 1/1894 | Ayre |
| 1,665,532 | A | | 4/1928 | Cook |
| 2,620,610 | A | | 12/1952 | Chambers |
| 2,790,366 | A | | 4/1957 | McKinzie |
| 2,797,542 | A | | 7/1957 | Webster et al. |
| 3,048,229 | A | | 8/1962 | Simpson |
| 3,101,794 | A | | 8/1963 | Bechman |
| 3,448,814 | A | | 6/1969 | Bentley et al. |
| 3,812,919 | A | | 5/1974 | Baughman et al. |
| 3,926,262 | A | | 12/1975 | Brooks |
| 3,952,490 | A | | 4/1976 | Brockman |
| 4,356,644 | A | | 11/1982 | Harkness |
| 4,393,943 | A | | 7/1983 | Andersson |
| 4,554,977 | A | * | 11/1985 | Vachon ..... A01B 49/027 172/177 |
| 4,858,698 | A | | 8/1989 | Williamson et al. |
| 4,898,247 | A | | 2/1990 | Springfield |
| 5,054,278 | A | | 10/1991 | Thorndike |

(Continued)

*Primary Examiner* — Robert E Pezzuto
(74) *Attorney, Agent, or Firm* — Taft Stettinius & Hollister LLP

(57) ABSTRACT

One embodiment is a tow-behind grading tool structured for attachment to a work machine. The tool includes a frame, ground contacting members rotatably coupled with the frame, a comb coupled with the frame and extending from a first end of the frame, a tow coupling member coupled with the frame and located proximate a second end of the frame, the second end of the frame being opposite the first end of the frame, a drag bar assembly including a plurality of arms rotatably coupled with the frame and drag bar rotatably coupled with the plurality of arms, and at least one spring coupled with the frame and the drag bar assembly such that the spring resists upward rotation of the drag bar and provides force urging the drag bar to rotate downward after upward rotation of the drag bar.

22 Claims, 5 Drawing Sheets

(56) References Cited

U.S. PATENT DOCUMENTS

| | | | | | |
|---|---|---|---|---|---|
| 5,140,763 | A * | 8/1992 | Nichols, IV | E01H 5/062 | 37/233 |
| 5,535,832 | A | 7/1996 | Beniot | | |
| 5,806,605 | A | 9/1998 | Keigley | | |
| 5,833,012 | A | 11/1998 | Pierce et al. | | |
| 5,988,294 | A * | 11/1999 | Hubscher | A01B 35/30 | 172/142 |
| 6,012,534 | A | 1/2000 | Kovach et al. | | |
| 6,032,746 | A | 3/2000 | Lowery | | |
| 6,739,404 | B2 | 5/2004 | Keigley | | |
| 7,543,401 | B2 * | 6/2009 | Hughes | E01H 5/062 | 37/232 |
| 9,826,672 | B1 * | 11/2017 | Kiser | A01B 45/00 | |
| 2008/0011496 | A1 | 1/2008 | Garrison et al. | | |

* cited by examiner

TOW-BEHIND GRADING TOOL AND OPERATION THEREOF

CROSS REFERENCE

The present application claims the benefit of U.S. Application No. 62/144,973 filed Apr. 9, 2016 the disclosure of which is hereby incorporated by reference.

BACKGROUND

The present application relates generally to tow-behind grading tools and the operation thereof. Such tools serve many useful purposes; however, there remain a number of unmet challenges in the art. Operators of tow-behind grading tools encounter a number of challenges and performance shortcoming including those relating to tool bogging, stalling or undesired lifting which may occur, for example, when a tool becomes overloaded or exceeds its ground surface working capacity. Further performance shortcomings include those respecting undesired compaction of the ground surface being worked and insufficient removal of spoils such as rocks and other undesired debris. There remains a significant need for the unique apparatuses, systems and methods disclosed herein.

DISCLOSURE OF ILLUSTRATIVE EMBODIMENTS

For the purposes of clearly, concisely and exactly describing exemplary embodiments of the invention, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art to which the invention relates.

SUMMARY

One embodiment is a tow-behind grading tool structured for attachment to a work machine. The tool includes a frame, ground contacting members rotatably coupled with the frame, a comb coupled with the frame and extending from a first end of the frame, a tow coupling member coupled with the frame and located proximate a second end of the frame, the second end of the frame being opposite the first end of the frame, a drag bar assembly including a plurality of arms rotatably coupled with the frame and drag bar rotatably coupled with the plurality of arms, and at least one spring coupled with the frame and the drag bar assembly such that the spring resists upward rotation of the drag bar and provides force urging the drag bar to rotate downward after upward rotation of the drag bar.

DETAILED DESCRIPTION OF ILLUSTRATIVE EMBODIMENTS

Figure 1:
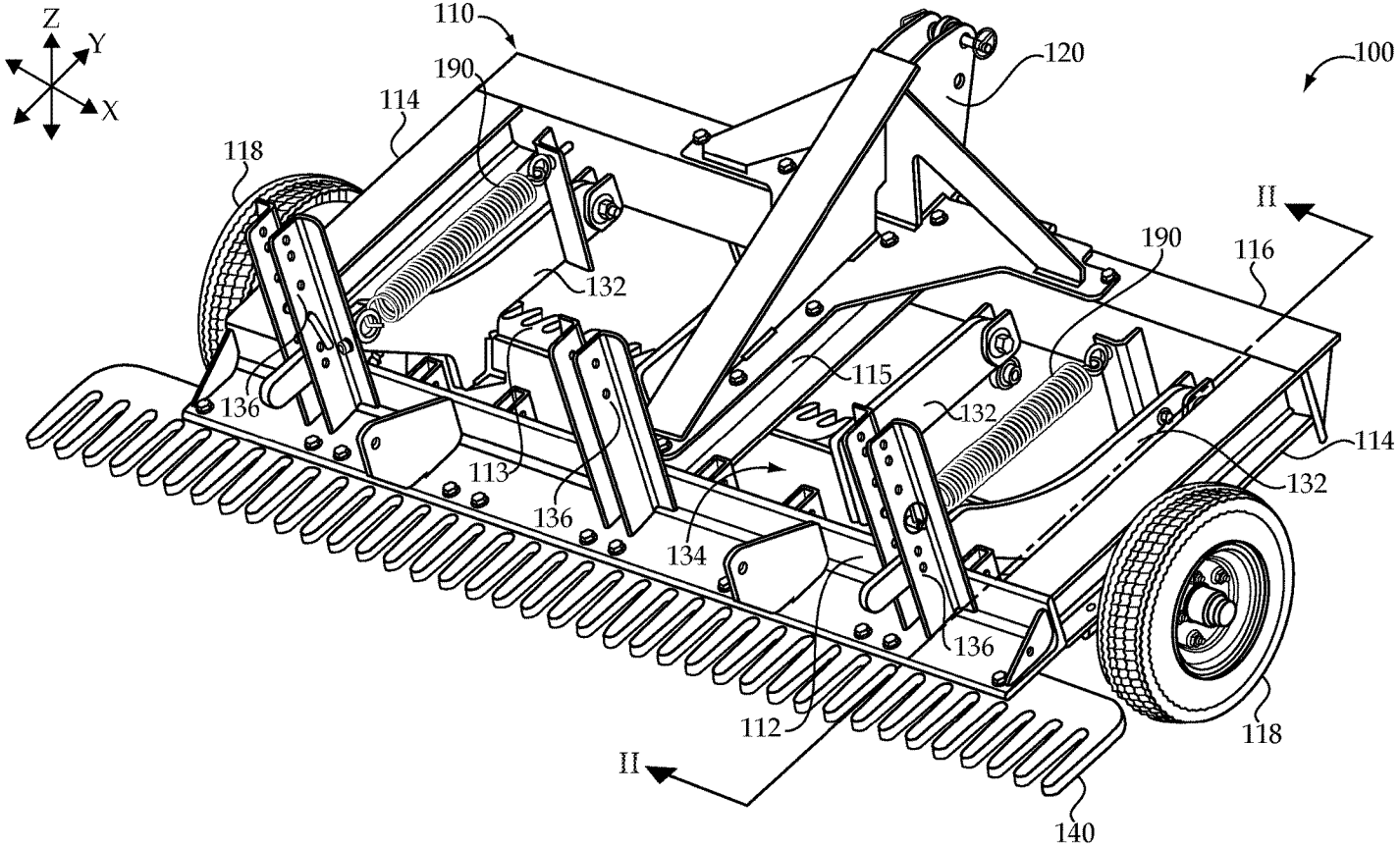
FIG. 1 is a perspective view of a tow-behind grading tool according to one exemplary embodiment.

With reference to FIG. 1 there is illustrated an exemplary grading tool 100 which includes frame 110, ground contacting wheels 118, comb 140, and drag bar assembly 134. Frame 110 includes rear frame member 112, front frame member 116, side frame members 114, and center frame member 115. Rear frame member 112 and front frame member 116 extend between first and second sides of grading tool 100 in a widthwise direction along the illustrated X-axis. Side frame members 114 and center frame member 115 extend between first and second ends of grading tool 100 in a lengthwise direction along the illustrated Y-axis.

Hitch attachment 120 is structured to be accessible from the front end of grading tool 100 and is structurally coupled with front frame member 116 as well as center frame member 115. In the illustrated embodiment, hitch attachment 120 is configured as a three-point hitch attachment. In other embodiments, hitch attachment 120 may be configured as a variety of other two-behind hitch structures including ball-type hitches, pintle-type hitches, and receiver-type hitches to name several examples. In certain additional embodiments the tool positioning functionality provided by attachment to a three point hitch may be duplicated or approximated by pitch and/or elevation adjustment mechanisms on-board tool 100. It shall be appreciated that the hitch attachment is one example of a tow coupling which may be utilized in towing tool 100.

Comb 140 is coupled with rear frame member 112 and extends over a distance in the widthwise direction of tool 100. Comb 140 includes a plurality of comb teeth extending over a second distance in the lengthwise direction. In the illustrated embodiment, comb 140 is comprised of a plurality of separate portions which are arranged adjacent one another and secured to rear frame member 112. This allows combs of differing widths to be provided from a common set of parts. Other embodiments contemplate that a single piece comb may be utilized. Scarifying teeth 105 (visible in FIGS. 2 and 3) are also coupled with rear frame member 112 at a location toward the front of grading tool 100 relative to comb 140. Scarifying teeth 105 are structured to be adjustable and removable relative to frame 110.

Ground contacting wheels 118 are rotatably coupled with side frame members 114 and are structured to support the frame 110 relative to an underlying ground surface. In the illustrated embodiment, ground contacting wheels 118 are positioned within the first distance in the widthwise direction such that the ground contacting wheels 118 may travel over a portion of the ground surface which will be worked by comb 140. In additional embodiments, other ground contacting members may be utilizes in addition to in instead of wheels 118 including treads, tracks, roll cages, skids, and rollers to name several examples. While the illustrated embodiment depicts two ground contacting wheels, it is contemplated that a greater or lesser number may be utilized.

Figure 2:
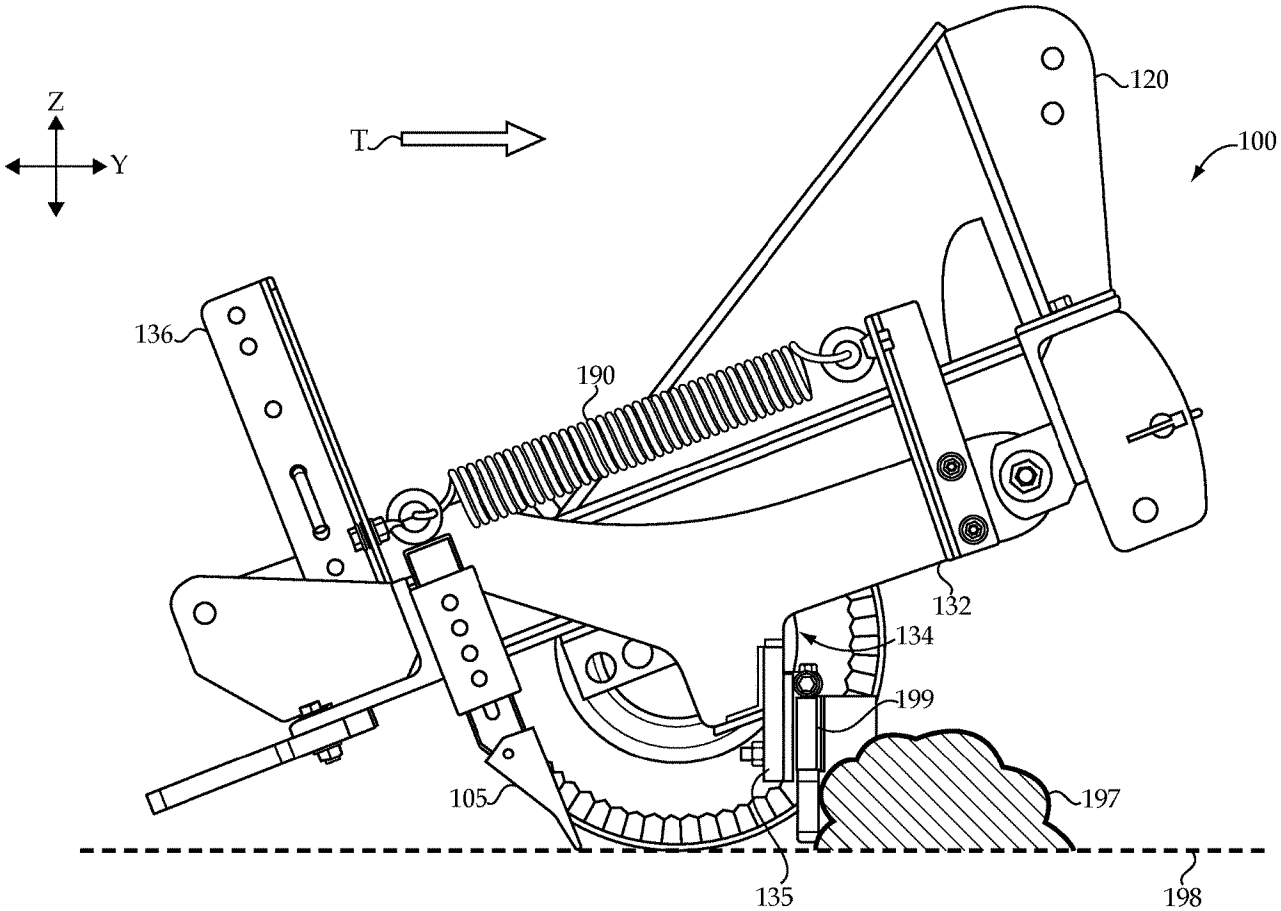
FIG. 2 is a side view of the tool of FIG. 1 in a first operational state.
Figure 3:
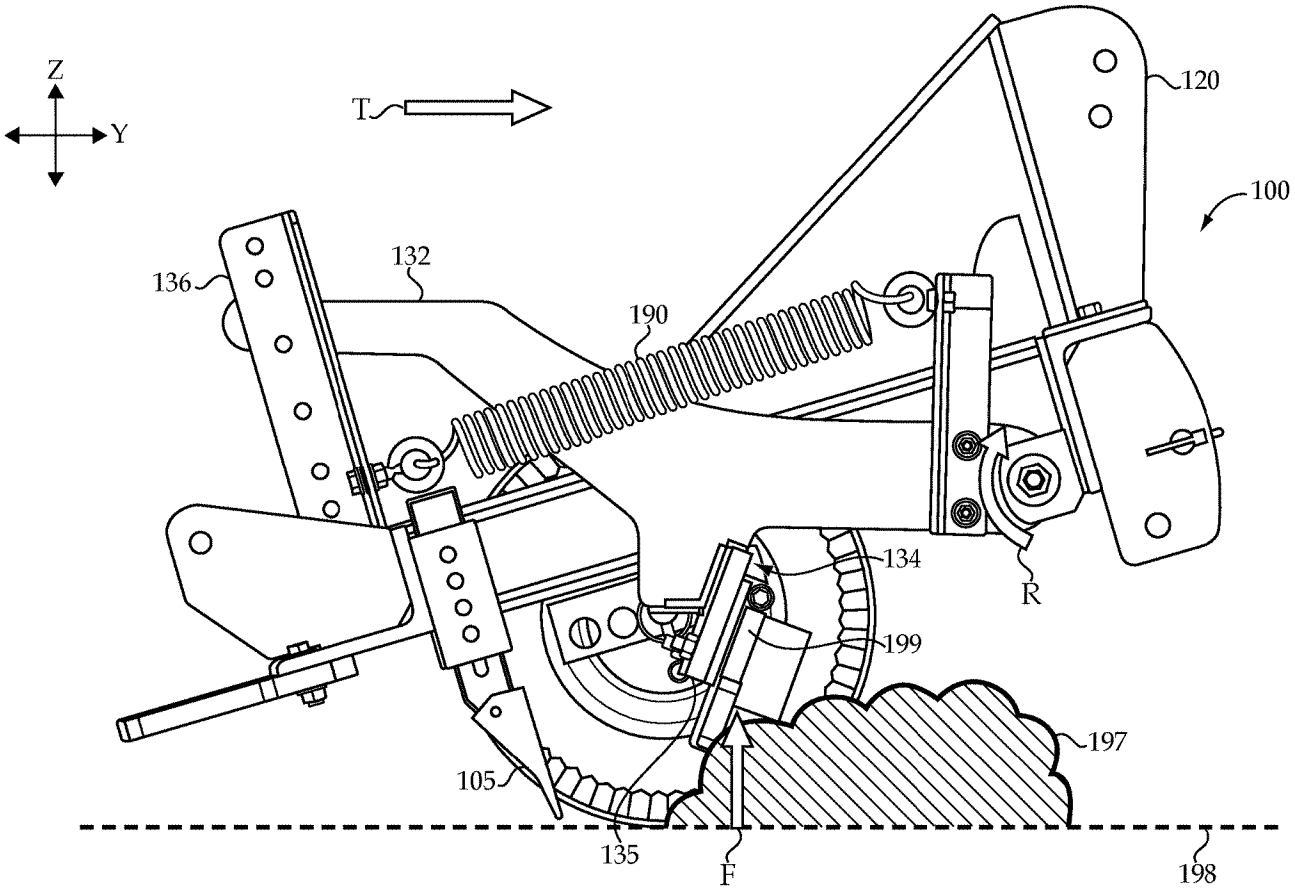
FIG. 3 is a side view of the tool of FIG. 1 in a second operational state.
Figure 4:
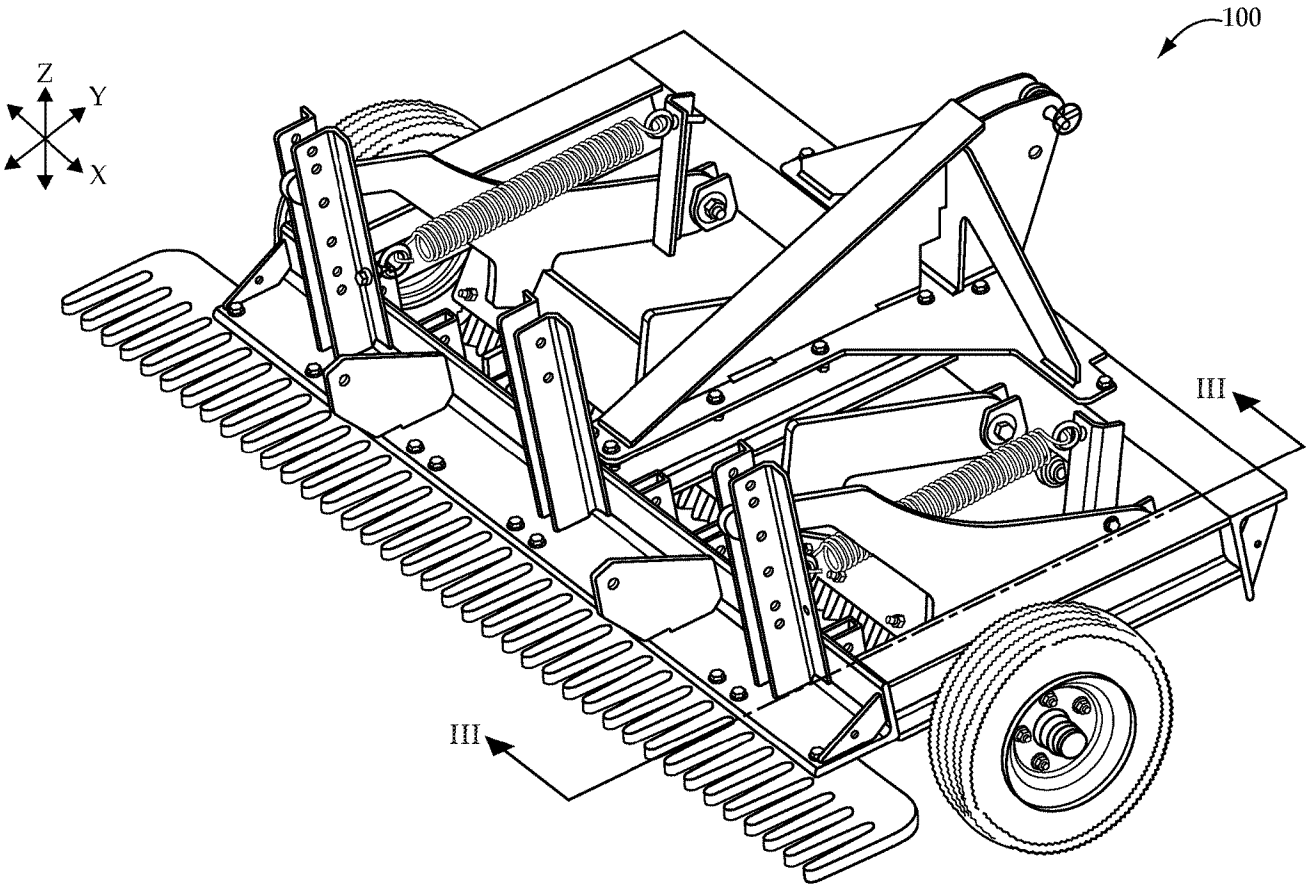
FIG. 4 is a perspective view of the tool of FIG. 1 in the second operational state.
Figure 5:
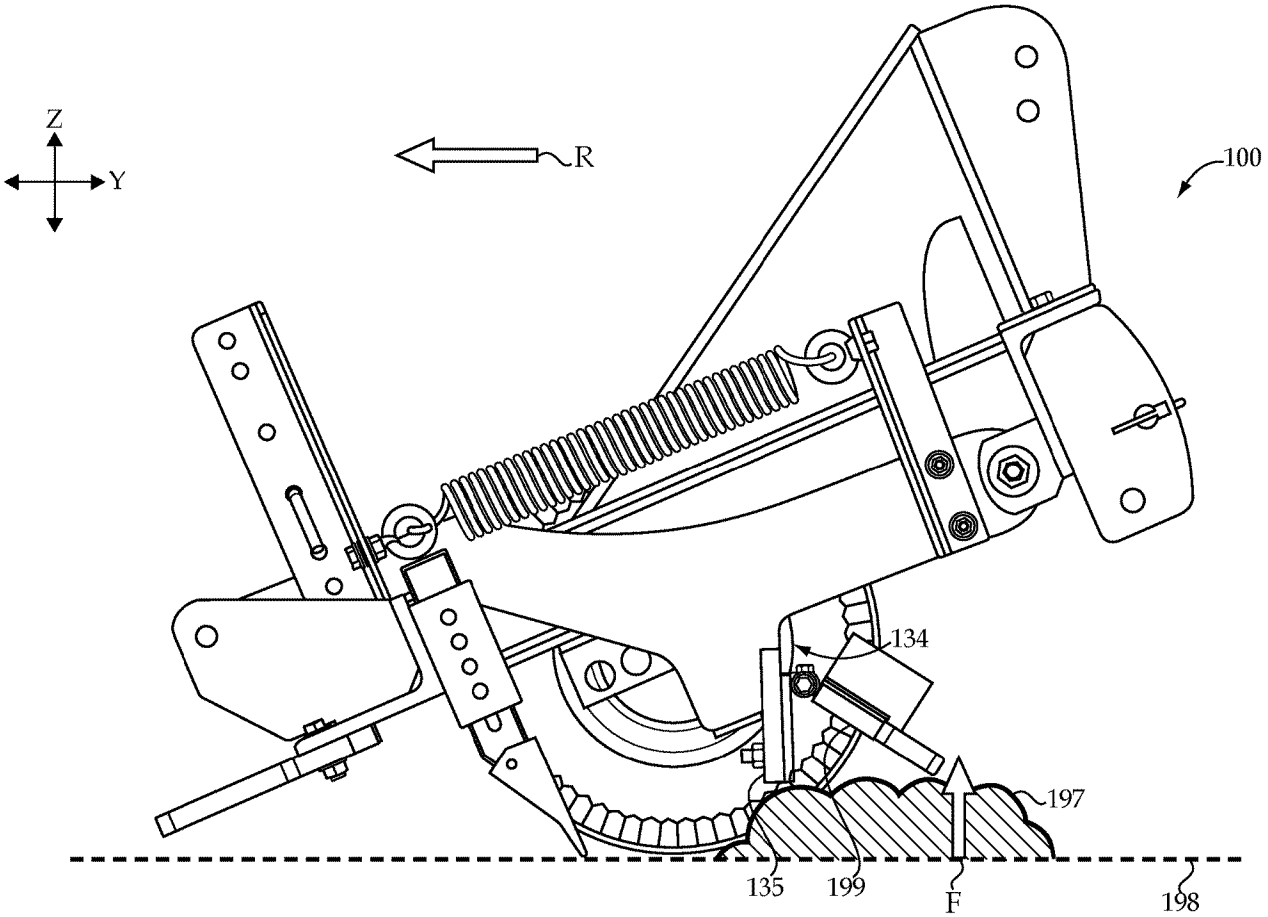
FIG. 5 is a perspective view of the tool of FIG. 2 in a third operational state.

Drag bar assembly 134 includes a plurality of arms 132 which are rotatably coupled to front frame member 116 by hinges. Rotation of arms 132 about the hinges allows the drag bar assembly to rotate so that it moves vertically relative to frame 110. Retention pin posts 136 extend vertically upward from rear frame member 112 and are structured to receive retention pins at any of a plurality of holes provided through retention pin posts 136. The end portions of two of the drag bar arms 132 extend into a slot provided in retention posts 136 and are structured to contact the retention pins to limit their movement. The limit on movement of arms 132 may be varied by changing the position of the retention pins in retention pin posts 136. As illustrated in FIGS. 2 and 3, drag bar assembly 134 includes carrier member 135 which is rotatably coupled with drag bar 199. A hinged connection between carrier member 135 and drag bar 199 allows drag bar 199 to rotate relative to carrier member 135 when tool 100 is advanced in the reverse direction which accommodates motion in the reverse direction while reducing or substantially eliminating resistance caused by contact between the drag bar 199 and underlying ground surface 198 or the worked ground material portion thereof 197. This movement is illustrated in FIG. 5. Drag bar 199 further includes a plurality of sifting teeth extending downward therefrom and side members which extend at angles relative to drag bar 199.

Tool 100 further includes spring assemblies 190 which are coupled with retention pin posts 136, extend generally along the length of tool 100, and are coupled to arms 132 at a location proximate the front end of tool 100. Spring assemblies 190 are structured to resists upward rotation of the drag bar assembly 134 and provide force urging the drag bar assembly 134 to rotate downward after upward rotation of the drag bar assembly. In the illustrated embodiments the springs of spring assemblies 190 are coupled with the frame proximate the rear end of the frame, extend along the length of the frame, and are coupled with arms 132 of the drag bar assembly at a location forward of the second end of the frame. It shall be appreciated that a variety of other springs, spring assemblies and connections of the same with tool 100 which resist upward rotation of the drag bar assembly 134 and provide force urging the drag bar assembly 134 to rotate downward after upward rotation of the drag bar assembly may be utilized. For example, the springs may extend in a more angled direction or in a vertical direction relative to frame 110, the connections of the springs may be made at different points on tool 100 including different portions of drag bar assembly 134, different portions of arms 132, different portions of frame 110, and/or different portions of posts 136 to name several examples. Furthermore, while the springs of spring assembly are illustrated as tension coil springs, a variety of other spring types may be utilized in other embodiments including compression coil springs, leaf springs, other types of torsion springs, cantilever springs, gas springs, and elastomeric springs to name several examples.

FIGS. 2 and 3 illustrate tool 100 in two operational states. In both operational states tool 100 is being towed in the direction indicated by arrow T. In the operational state of FIG. 2 drag bar assembly is rotated downward and is working underlying ground surface 198 such that worked ground matter 197 has accumulated in front of drag bar 199 and is sifted and smoothed by the teeth thereof. In this configuration spring assemblies 190 provide force resisting upward rotation of drag bar assembly 134. This allows for several unexpected results. First, the tool exhibits an increased gathering capability for spoils (e.g., rocks, debris and other unwanted non-soil material) by providing increased downward force that maintains the teeth of comb 140 in a working position allowing soil to pass through the comb teeth but resisting upward motion of the comb that would otherwise position the comb teeth to allow matter (soil and/or spoils) to pass underneath the raised comb teeth becomes bogged down or stalls. Second, the tool experiences a quick reciprocating motion or oscillation which forces spoils in the forward direction due to rotational raking-type action of the comb thus further increasing the amount of spoils that can be gathered by the tool. This type of passive, non-motorized raking action significantly increases the spoil gathering capability of the tool without compacting the soil as would occur with a land-box type tool. In other words the spring action of the tool allows the comb to float on the ground surface being worked and gather spoils on the upper surface of the combed soil without a buildup and packing effect. In certain embodiments, the oscillation motion of the tool may be of a frequency greater than the rotational frequency of the ground contacting wheels such that back and forth raking motion occurs at a rate greater than the rate of rotation of the wheels.

In the operational state of FIG. 3 drag bar assembly has rotated upward away from underlying ground surface 198 in response to increased force in the direction of arrow F attributable to an increase in the worked ground matter 197. In this configuration a quantity of worked ground matter 197 is allowed to pass under drag bar 199 while spring assemblies 190 provide force urging downward rotation of drag bar assembly 134. This force returns drag bar 199 to a working position once a sufficient amount of worked ground matter 197 has passed under drag bar 199. During operation tool 100 may transition repeatedly between the operational states of FIGS. 2 and 3 which is effective to provide reciprocating or oscillating working action on drag bar 199. As noted above, this operation has provided unexpected benefits, efficacy and efficacy of tool 100 in grading operations. This also avoids undesired compaction of the underlying ground surface which can occur if a tool bogs down or stalls It shall be understood that the exemplary embodiments summarized and described in detail and illustrated in the figures are illustrative and not limiting or restrictive. Only the presently preferred embodiments have been shown and described and all changes and modifications that come within the scope of the invention are to be protected. It shall be appreciated that the embodiments and forms described above may be combined in certain instances and may be exclusive of one another in other instances. Likewise, it shall be appreciated that the embodiments and forms described above may or may not be combined with other aspects and features. It should be understood that various features and aspects of the embodiments described above may not be necessary and embodiments lacking the same are also protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A tow-behind grading tool comprising:

a frame;

ground contacting members rotatably coupled with the frame and structured to contact an underlying ground surface;

a comb coupled with the frame and extending from a first end of the frame, the comb being selectably engagable with the underlying ground surface by rotation of the frame relative to the underlying ground surface;

a tow coupling member coupled with the frame and located proximate a second end of the frame, the second end of the frame being opposite the first end of the frame;

a drag bar assembly including a plurality of arms rotatably coupled with the frame and a drag bar rotatably coupled with the plurality of arms, the drag bar assembly being rotatable relative to the frame to raise and lower the drag bar relative to the underlying ground surface independent of movement of the frame, and the drag bar being rotatable relative to the arms to raise and lower the drag bar relative to the underlying ground surface independent of movement of the arms and independent of movement of the frame, wherein the drag bar is rotatable relative to the arms without a bias in either rotational direction; and a spring coupled with the frame and the drag bar assembly such that the spring resists upward rotation of the drag bar away from the underlying ground surface and provides force urging the drag bar to rotate downward after upward rotation of the drag bar.

2. The tool of claim 1 wherein the spring is coupled with the frame proximate the first end of the frame, extends along the length of the frame, and is coupled with at least one of the plurality of arms of the drag bar assembly at a location toward the second end of the frame.

3. The tool of claim 1 comprising a plurality of springs coupled with the frame and the drag bar assembly such that the springs resists upward rotation of the drag bar and provide force urging the drag bar to rotate downward after upward rotation of the drag bar.

4. The tool of claim 1 wherein the drag bar includes a plurality of sifting teeth structured to engage the ground surface when the grading tool is advanced in a forward direction.

5. The tool of claim 4 wherein the sifting teeth are coupled to the drag bar assembly with a hinge mechanism.

6. The tool of claim 5 wherein the sifting teeth rotate upward in response to force from the ground surface when the grading tool is advanced in a reverse direction.

7. The tool of claim 1 wherein the drag bar is coupled to a carrier member of the drag bar assembly and the drag bar is configured to rotate until it contacts the carrier member when the tool is moved in a forward direction and configured to rotate away from the carrier member when the tool is moved in a reverse direction.

8. A tow-behind grading tool comprising:

a frame extending along a length from a first end to a second end and extending along a width perpendicular to the length from a first side to a second side;

a ground contacting member rotatably coupled with the frame and structured to contact an underlying ground surface;

a tow coupling member coupled with the frame and located proximate the second end of the frame;

a drag bar assembly including an arm coupled with the frame such that the arm is rotatable relative to the frame to raise and lower the drag bar assembly relative to the underlying ground surface, the drag bar assembly including a drag bar rotatably coupled with the arm without rotational bias such that the drag bar is rotatable relative to the arm to move the drag bar relative to the underlying ground surface; and a spring coupled with the frame and the drag bar assembly such that the spring resists upward rotation of the drag bar and provides force urging the drag bar to rotate downward in response to upward rotation of the drag bar.

9. The tool of claim 8 wherein the spring is structured with a spring constant effective to cause the drag bar to oscillate with a raking motion as the tool is advanced in a first direction.

10. The tool of claim 9 wherein the oscillation with a raking motion has an oscillation frequency greater than the frequency of rotation of the ground contacting member when the tool is advanced in the first direction.

11. The tool of claim 8 wherein the drag bar is configured to rotate in a first direction to a fixed working position when the tool is moved in a forward direction and configured to rotate in a second direction opposite the first position to minimize resistance caused by contact between the drag bar and an underlying ground surface when the tool is moved in a reverse direction.

12. The tool of claim 8 wherein the tow coupling member comprises a three-point hitch assembly.

13. A method comprising:

towing a grading tool comprising a frame, ground contacting wheels coupled with the frame, a first tool coupled with the frame proximate a first end of the frame, a tow coupling member coupled with the frame and located proximate a second end of the frame, the second end of the frame being opposite the first end of the frame, a drag bar assembly including a plurality of arms rotatably coupled with the frame, a drag bar coupled with the plurality of arms, and at least one spring coupled with the frame and the drag bar assembly;

wherein the spring opposes upward rotation of the drag bar and provides force urging the drag bar to rotate downward after upward rotation of the drag bar and during the towing the drag bar repeatedly rotates upward and downward in response to force applied by ground material contacting the drag bar, and the drag bar oscillates at a frequency greater than the rotational frequency of the ground contacting wheels such that back and forth raking motion occurs at a rate greater than the rate of rotation of the wheels.

14. The method of claim 13 wherein the repeated upward and downward movement of the drag bar allows ground material to pass under the drag bar to prevent stalling or lifting of the tool attributable to an accumulation of ground material in contact with the drag bar.

15. The method of claim 13 wherein the drag bar assembly includes a carrier member coupled with the plurality of arms, rotatably coupled with the drag bar and extending in a direction along the width of the frame.

16. The method of claim 13 comprising a plurality of springs coupled with the frame and the drag bar assembly such that the springs resists upward rotation of the drag bar and provide force urging the drag bar to rotate downward after upward rotation of the drag bar.

17. The method of claim 13 wherein the drag bar includes a plurality of sifting teeth structured to engage the ground surface when the grading tool is advanced in a forward direction.

18. The method of claim 17 wherein the sifting teeth are coupled to the drag bar assembly with a hinge mechanism.

19. The method of claim 18 wherein the sifting teeth rotate upward in response to force from the ground surface when the grading tool is advanced in a reverse direction.

20. The method of claim 13 wherein a comb extends over a first distance along a width of the frame and the ground contacting wheels are positioned to contact the ground within the first distance.

21. The method of claim 13 wherein the coupling member comprises a three-point hitch assembly.

22. The method of claim 13 further comprising self-propelled work machine operatively coupled with the grading tool.

* * * * *